US012654976B2

(12) United States Patent
Shimizu et al.

(10) Patent No.: US 12,654,976 B2
(45) Date of Patent: Jun. 16, 2026

(54) TRANSPORT DEVICE AND RECORDING APPARATUS

(71) Applicant: SEIKO EPSON CORPORATION, Tokyo (JP)

(72) Inventors: Sho Shimizu, Shiojiri (JP); Hiroki Aoki, Nagano (JP); Ryosuke Ban, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 489 days.

(21) Appl. No.: 18/048,921

(22) Filed: Oct. 24, 2022

(65) Prior Publication Data

US 2023/0126527 A1 Apr. 27, 2023

(30) Foreign Application Priority Data

Oct. 27, 2021 (JP) ..... 2021-175299

(51) Int. Cl.
*B65H 43/00* (2006.01)
*B65H 5/02* (2006.01)

(52) U.S. Cl.
CPC ..... *B65H 43/00* (2013.01); *B65H 5/021* (2013.01); *B65H 2515/31* (2013.01); *B65H 2515/50* (2013.01); *B65H 2515/84* (2013.01)

(58) Field of Classification Search
CPC .... B65H 43/00; B65H 5/021; B65H 2515/31; B65H 2515/50; B65H 2515/84; B41J 3/4078; B41J 11/007; B41J 15/048; B41J 11/42
See application file for complete search history.

(56) References Cited

U.S. PATENT DOCUMENTS

| | | | | |
|---|---|---|---|---|
| 9,284,140 | B2 | 3/2016 | Horaguchi | |
| 9,662,913 | B2 * | 5/2017 | Tanabe | B41J 2/21 |
| 10,160,235 | B2 * | 12/2018 | Tomioka | B41J 15/048 |
| 2012/0263514 | A1 * | 10/2012 | Tanami | B41J 15/04 400/613 |
| 2013/0135379 | A1 * | 5/2013 | Hori | B41J 15/165 347/102 |
| 2015/0183604 | A1 * | 7/2015 | Horaguchi | B65H 7/02 271/275 |
| 2018/0345687 | A1 * | 12/2018 | Tokai | B41J 11/46 |

FOREIGN PATENT DOCUMENTS

| | | | |
|---|---|---|---|
| CN | 108946048 | 12/2018 | |
| EP | 3378661 A | 9/2018 | |
| EP | 3403834 | 11/2018 | |
| EP | 3403834 A1 * | 11/2018 | B65H 7/02 |

(Continued)

*Primary Examiner* — Gene O Crawford
*Assistant Examiner* — Abby A Jorgensen
(74) *Attorney, Agent, or Firm* — WORKMAN NYDEGGER

(57) ABSTRACT

A transport device includes a transport belt configured to alternately repeat a transport operation of transporting a medium and a non-transport operation of not transporting the medium, a detection mechanism configured to detect a movement amount of the transport belt in the transport operation, and a control section configured to determine a magnitude of tension of the transport belt based on a vibration state of the transport belt when the transport operation ends, the vibration state being detected by the detection mechanism.

7 Claims, 10 Drawing Sheets

(56) References Cited

FOREIGN PATENT DOCUMENTS

| | | | | | |
|---|---|---|---|---|---|
| EP | 3403835 | | | 11/2018 | |
| EP | 3403835 | A1 | * | 11/2018 | ..... B41J 3/44 |
| EP | 3680107 | A1 | * | 7/2020 | ..... B41J 3/4078 |
| EP | 3798010 | | | 3/2021 | |
| JP | H08-141969 | | | 6/1996 | |
| JP | H8-286562 | A | | 11/1996 | |
| JP | 2004-010323 | | | 1/2004 | |
| JP | 2004010323 | A | * | 1/2004 | ..... B66B 23/026 |
| JP | 2010-097057 | | | 4/2010 | |
| JP | 2013-001512 | | | 1/2013 | |
| JP | 2015-124044 | | | 7/2015 | |
| JP | 2018-154071 | A | | 10/2018 | |
| JP | 2018-193199 | | | 12/2018 | |
| JP | 2021-041657 | | | 3/2021 | |
| JP | 2021-147181 | | | 9/2021 | |
| WO | WO-02077108 | A2 | * | 10/2002 | ..... B41J 2/17553 |
| WO | 2012/173176 | | | 12/2012 | |

* cited by examiner

TRANSPORT DEVICE AND RECORDING APPARATUS

The present application is based on, and claims priority from JP Application Serial Number 2021-175299, filed Oct. 27, 2021, the disclosure of which is hereby incorporated by reference herein in its entirety.

BACKGROUND

1. Technical Field

The present disclosure relates to a transport device and a recording apparatus.

2. Related Art

In the related art, as shown in JP-A-2018-154071, there has been known a printing apparatus including a transport belt capable of supporting a medium, a drive roller for rotating the transport belt, and a tension measuring section for measuring the tension of the transport belt. The tension measuring section is a microphone capable of detecting a sound wave generated by vibrating the transport belt with a hammer.

However, the printing apparatus described in JP-A-2018-154071 has a configuration in which the tension measuring section for measuring the tension of the transport belt is separately required, and there is a problem in that the configuration of the printing apparatus is complicated.

SUMMARY

A transport device includes a transport belt configured to alternately repeat a transport operation of transporting a medium and a non-transport operation of not transporting the medium, a detection mechanism configured to detect a movement amount of the transport belt in the transport operation, and a control section configured to determine a magnitude of tension of the transport belt based on a vibration state of the transport belt when the transport operation ends, the vibration state being detected by the detection mechanism.

A transport device includes a transport belt configured to alternately repeat a transport operation of transporting a medium and a non-transport operation of not transporting the medium, a detection mechanism configured to detect a movement amount of the transport belt in the transport operation, a drive roller that is provided downstream of the detection mechanism in a transport direction, which the medium is transported, and that rotationally moves the transport belt, and a control section configured to determine a magnitude of tension of the transport belt based on a difference between a target speed of the transport belt and a detected speed of the transport belt detected by the detection mechanism.

A recording apparatus includes a recording section configured to record on a medium, a transport belt configured to alternately repeat a transport operation of transporting the medium and a non-transport operation of not transporting the medium, a detection mechanism configured to detect a movement amount of the transport belt in the transport operation, and a control section configured to determine a magnitude of tension of the transport belt based on a vibration state of the transport belt when the transport operation ends, the vibration state being detected by the detection mechanism.

A recording apparatus includes a recording section configured to record on a medium, a transport belt configured to alternately repeat a transport operation of transporting the medium and a non-transport operation of not transporting the medium, a detection mechanism configured to detect a movement amount of the transport belt in the transport operation, a drive roller that is provided downstream of the detection mechanism in a transport direction, which the medium is transported, and that rotationally moves the transport belt, and a control section configured to determine a magnitude of tension of the transport belt based on a difference between a target speed of the transport belt and a detected speed of the transport belt detected by the detection mechanism.

DESCRIPTION OF EMBODIMENTS

1. First Embodiment

First, configuration of a recording apparatus 100 will be described. The recording apparatus 100 according to the embodiment is an ink jet printer that performs textile printing on a medium M by forming an image or the like on the medium M.

Figure 1:
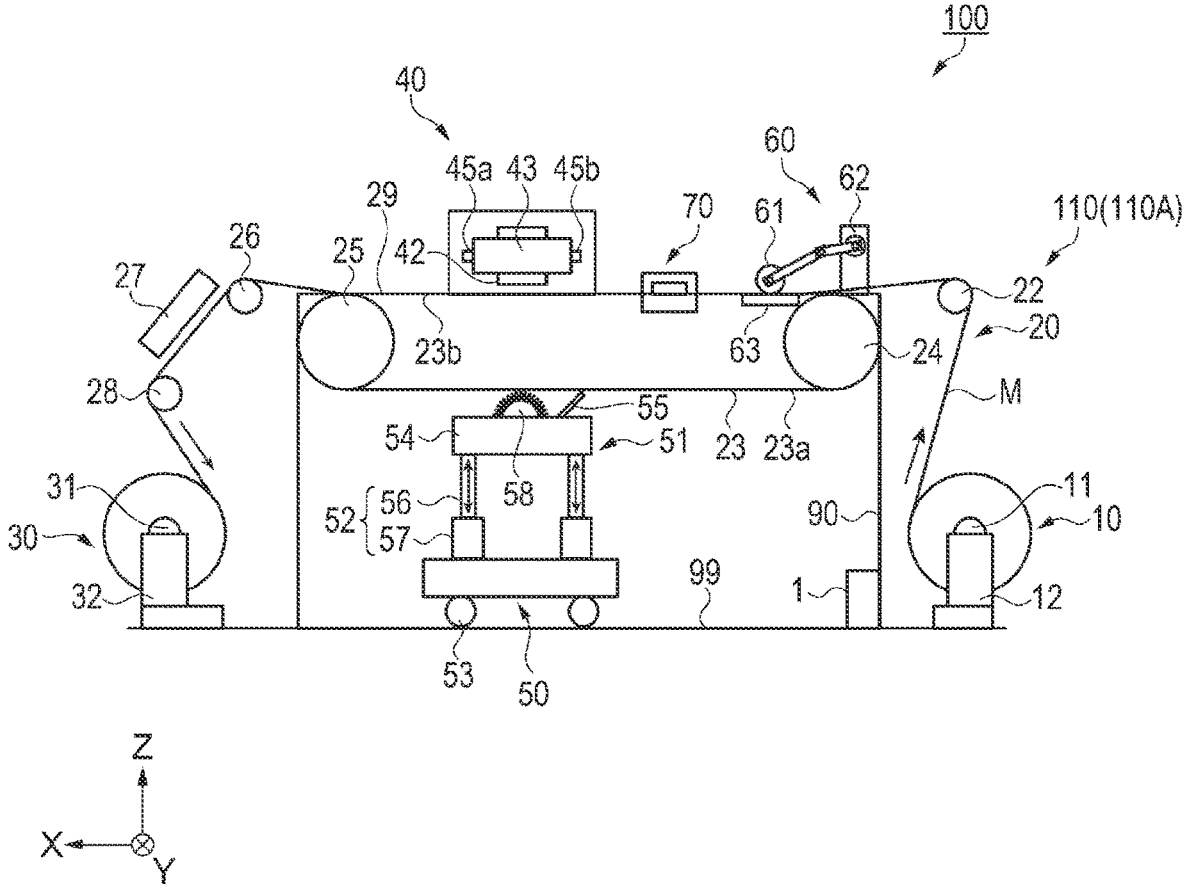
FIG. 1 is a schematic diagram showing configuration of a recording apparatus according to a first embodiment.
Figure 2:
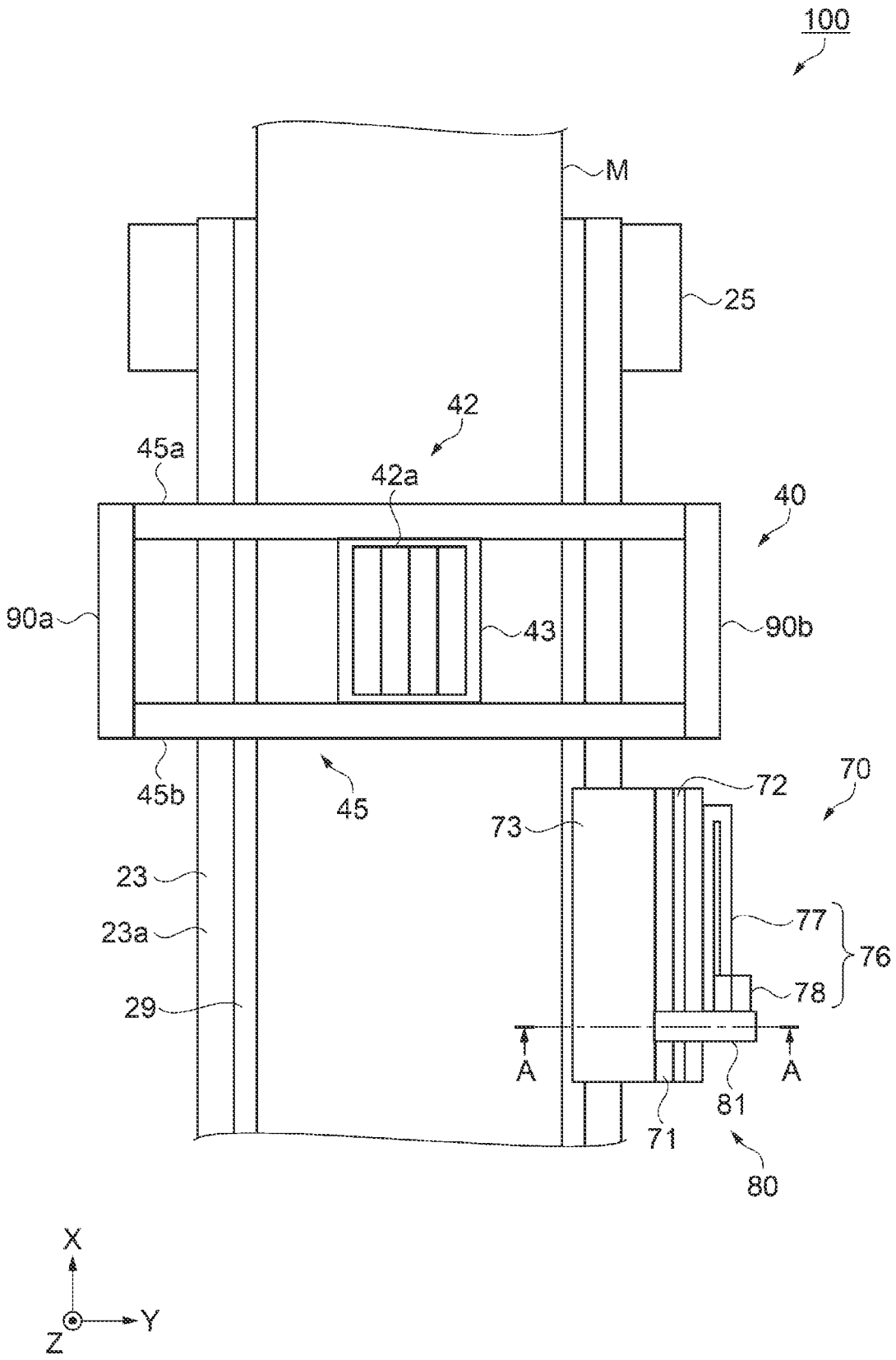
FIG. 2 is a plan view showing partial configuration of the recording apparatus according to the first embodiment.

As shown in FIGS. 1 and 2, the recording apparatus 100 includes a transport device 110 and a recording section 40. The transport device 110 includes a medium transport section 20 and a detection mechanism 70. Further, the recording apparatus 100 includes a medium contact section 60, a drying unit 27, a washing unit 50, and the like. The recording apparatus 100 includes a control section 1 that controls these sections, mechanisms, and units. The sections and the like of the recording apparatus 100 are attached to a frame section 90.

The medium transport section 20 transports the medium M in a transport direction. The medium transport section 20 includes a medium supply section 10, a transport roller 22, a transport belt 23, a rotation roller 24, a drive roller 25, a transport roller 26 and a transport roller 28, and a medium collection section 30.

In the present embodiment, each unit of the recording apparatus 100 will be described using an XYZ coordinate system in which an X axis, a Y axis, and a Z axis are orthogonal to each other. A direction along the X axis is defined as an X direction, a direction along the Y axis is defined as a Y direction, and a direction along the Z axis is defined as a Z direction. Further, a tip end side of the arrow indicating the direction is defined as a + direction, and a base end side of the arrow indicating the direction is defined as a − direction. A direction in which gravity acts on the recording apparatus 100 is defined as the Z direction, a direction along a direction in which the medium M is transported in the recording section 40 is defined as the X direction, and a width direction of the medium M that intersects both the Z direction and the X direction is defined as the Y direction. Positional relationships along the transport direction of the medium M or the moving direction of the transport belt 23 are also referred to as "upstream" or "downstream".

The medium supply section 10 supplies the medium M on which an image is to be formed to the recording section 40 side. As the medium M, for example, a fabric such as cotton, wool, or polyester is used. The medium supply section 10 includes a supply shaft section 11 and a bearing section 12. The supply shaft section 11 is formed in a cylindrical shape or a columnar shape, and is provided rotatable in a circumferential direction. The strip-shaped medium M is wound in a roll shape around the supply shaft section 11. The supply shaft section 11 is detachably attached to the bearing section 12. Thus, the medium M previously wound around the supply shaft section 11 can be attached to the bearing section 12 together with the supply shaft section 11.

The bearing section 12 rotatably supports both ends of the supply shaft section 11 in an axial direction. The medium supply section 10 has a rotation drive section (not shown) for rotationally driving the supply shaft section 11. The rotation drive section rotates the supply shaft section 11 in a direction in which the medium M is sent out. The operation of the rotation drive section is controlled by the control section 1. The transport roller 22 relays the medium M from the medium supply section 10 to the transport belt 23.

The transport belt 23 is held between at least two rollers that rotate the transport belt 23, and the medium M is transported in the transport direction (+X direction) by the rotational movement of the transport belt 23. Specifically, the transport belt 23 is formed in an endless shape by connecting both end portions of a strip-shaped belt together, and is wound around two rollers of the rotation roller 24 and the drive roller 25. The transport belt 23 is held in a state in which a predetermined tension acts so that the portion between the rotation roller 24 and the drive roller 25 becomes horizontal. An adhesive layer 29 that adheres the medium M is provided on a front surface 23*a* (support face) of the transport belt 23. The transport belt 23 supports (holds) the medium M supplied from the transport roller 22 and is brought into intimate contact with the adhesive layer 29 by the medium contact section 60 (to be described later).

The rotation roller 24 and the drive roller 25 support a back surface 23*b* (inner peripheral surface) of the transport belt 23. In addition, a configuration may be employed in which a supporting section, such as a roller that supports the transport belt 23, is provided between the rotation roller 24 and the drive roller 25.

The drive roller 25 is a drive section that rotationally moves the transport belt 23, and power is directly or indirectly transmitted from a motor (not shown) that rotationally drives the drive roller 25. The drive roller 25 is provided downstream of the recording section 40 and the rotation roller 24 is provided upstream of the recording section 40, with respect to the transport direction of the medium M. When the drive roller 25 is rotationally driven, the transport belt 23 rotates with the rotation of the drive roller 25, and the rotation roller 24 rotates with the rotation of the transport belt 23. By the rotation of the transport belt 23, the medium M supported by the transport belt 23 is transported in the transport direction, and an image is formed on the medium M by the recording section 40 (to be described later).

The drive roller 25 is controlled so as to intermittently transport the transport belt 23. That is, the transport belt 23 can alternately repeat a transport operation of transporting the medium M in the transport direction and a non-transport operation of not transporting the medium M.

In the embodiment, the medium M is supported on the side (+Z direction side) where the front surface 23*a* of the transport belt 23 faces the recording section 40, and the medium M is transported from the rotation roller 24 side to the drive roller 25 side together with the transport belt 23. On the side (−Z direction side) where the front surface 23*a* of the transport belt 23 faces the washing unit 50, only the transport belt 23 moves from the drive roller 25 side to the rotation roller 24 side. Although the transport belt 23 has been described as including the adhesive layer 29 that causes the medium M to make intimate contact, the disclosure is not limited thereto. For example, an electrostatic adsorption type belt that makes the medium M cling to the transport belt 23 by static electricity may be used, and various cling force generation mechanisms such as vacuum suction or intermolecular force may be employed.

The transport roller 26 peels the medium M, which an image is formed, from the adhesive layer 29 of the transport belt 23. The transport rollers 26, 28 relay the medium M from the transport belt 23 to the medium collection section 30.

The medium collection section 30 collects the medium M transported by the medium transport section 20. The medium collection section 30 includes a winding shaft section 31 and a bearing section 32. The winding shaft section 31 is formed in a cylindrical shape or a columnar shape, and is provided rotatable in a circumferential direction. The medium M having a strip-shape is wound into a roll on the winding shaft section 31. The winding shaft section 31 is detachably attached to the bearing section 32. Thus, the medium M in the state of being wound around the winding shaft section 31 can be removed together with the winding shaft section 31.

The bearing section 32 rotatably supports both ends of the winding shaft section 31 in an axial direction. The medium collection section 30 has a rotation drive section (not shown) for rotationally driving the winding shaft section 31. The rotation drive section rotates the winding shaft section 31 in a direction in which the medium M is wound. The operation of the rotation drive section is controlled by the control section 1.

Next, a description will be given of the medium contact section 60, the detection mechanism 70, the recording section 40, the drying unit 27 and the washing unit 50 provided along the medium transport section 20.

The medium contact section 60 brings the medium M into intimate contact with the transport belt 23. The medium contact section 60 is provided upstream (on the −X direction side) of the recording section 40. The medium contact section 60 includes a pressing roller 61, a pressing roller drive section 62, and a roller support section 63. The pressing roller 61 is formed in a cylindrical shape or a columnar shape, and is provided so as to be rotatable in a circumferential direction. The pressing roller 61 is rotatable about an axis and is arranged so that the direction of the axis intersects with the transport direction. The roller support section 63 is provided on the back surface 23*b* side of the transport belt 23 facing the pressing roller 61 with the transport belt 23 interposed therebetween.

The pressing roller drive section 62 moves the pressing roller 61 in the transport direction (+X direction) and a direction opposite to the transport direction (−X direction) while pressing the pressing roller 61 to the −Z direction side. The medium M superimposed on the transport belt 23 is pressed against the transport belt 23 between the pressing roller 61 and the roller support section 63. Accordingly, the medium M can be reliably caused to adhere to the adhesive layer 29 provided on the front surface 23*a* of the transport belt 23, and floating of the medium M on the transport belt 23 can be prevented.

The detection mechanism 70 is provided between the medium contact section 60 and the recording section 40. The detection mechanism 70 detects the movement amount of the transport belt 23 in the transport operation of transporting the medium M. The configuration of the detection mechanism 70 will be described later.

The recording section 40 is disposed above (+Z direction side) with respect to an arrangement position of the transport belt 23, and performs printing (recording) on the medium M supported on the front surface 23*a* of the transport belt 23. The recording section 40 includes a head unit 42, a carriage 43 on which the head unit 42 is mounted, and a carriage moving section 45 for moving the carriage 43 in the width direction (along the Y axis) of the medium M, which intersects with the transport direction, and the like. The head unit 42 of the present embodiment is composed of four sub units 42*a*, and the sub units 42*a* include a plurality of discharge heads that discharge, as droplets, ink (for example, yellow, cyan, magenta, black, or the like) supplied from an ink supply section (not shown) to the medium M supported by the transport belt 23.

The carriage moving section 45 is provided above the transport belt 23 (on the +Z direction side). The carriage moving section 45 has a pair of guide rails 45*a*, 45*b* extending in a direction along the Y axis. The guide rails 45*a*, 45*b* are bridged between frame sections 90*a*, 90*b* provided vertically on the outer side of the transport belt 23. The head unit 42 is supported by the guide rails 45*a*, 45*b* so as to be capable of reciprocating in a direction along the Y axis together with the carriage 43.

The carriage moving section 45 includes a moving mechanism and a power source (not shown). As the moving mechanism, for example, a mechanism in which a ball screw and a ball nut are combined, a linear guide mechanism, or the like can be adopted. Further, the carriage moving section 45 has a motor (not shown) as the power source for moving the carriage 43 along the guide rails 45*a*, 45*b*. As the motor, various motors, such as a stepping motor, a servo motor, and a linear motor, can be adopted. When the motor is driven under the control of the control section 1, the head unit 42 moves along the Y axis together with the carriage 43.

The drying unit 27 is provided between the transport roller 26 and the transport roller 28. The drying unit 27 is for drying the ink ejected onto the medium M, and the drying unit 27 includes, for example, an IR heater, and by driving the IR heater, the ink ejected onto the medium M can be dried in a short time. Accordingly, the strip-shaped medium M on which an image or the like is formed can be wound around the winding shaft section 31.

The washing unit 50 is disposed below the transport belt 23 and between the rotation roller 24 and the drive roller 25 in the direction along the X axis. The washing unit 50 includes a washing section 51, a pressing section 52, and a moving section 53. The moving section 53 integrally moves the washing unit 50 along a floor surface 99 and fixes it at a predetermined position.

The pressing section 52 is, for example, an elevating device composed of an air cylinder 56 and a ball bush 57, and causes the washing section 51 provided in an upper portion thereof to come into contact with the front surface 23*a* of the transport belt 23. The washing section 51 washes the front surface 23*a* (support face) of the transport belt 23 moving from the drive roller 25 toward the rotation roller 24, from below (−Z direction).

The washing section 51 includes a washing tank 54, a washing roller 58, and a blade 55. The washing tank 54 is a tank that stores a washing liquid used for washing ink or foreign substances adhering to the front surface 23*a* of the transport belt 23, and the washing roller 58 and the blade 55 are provided inside the washing tank 54. As the washing liquid, for example, water or a water soluble solvent (an aqueous alcohol solution or the like) can be used, and a surfactant or a defoaming agent may be added as necessary.

When the washing roller 58 rotates, the washing liquid is supplied to the front surface 23*a* of the transport belt 23, and the washing roller 58 and the transport belt 23 slide on each other. As a result, ink, fibers from the cloth as the medium M, and the like adhering to the transport belt 23 are removed by the washing roller 58.

The blade 55 is made of a flexible material such as silicon rubber, for example. The blade 55 is provided downstream of the washing roller 58 in the transport direction of the transport belt 23. When the transport belt 23 and the blade 55 slide, the washing liquid remaining on the front surface 23*a* of the transport belt 23 is removed.

Next, the configuration of the detection mechanism 70 will be described.

Figure 3:
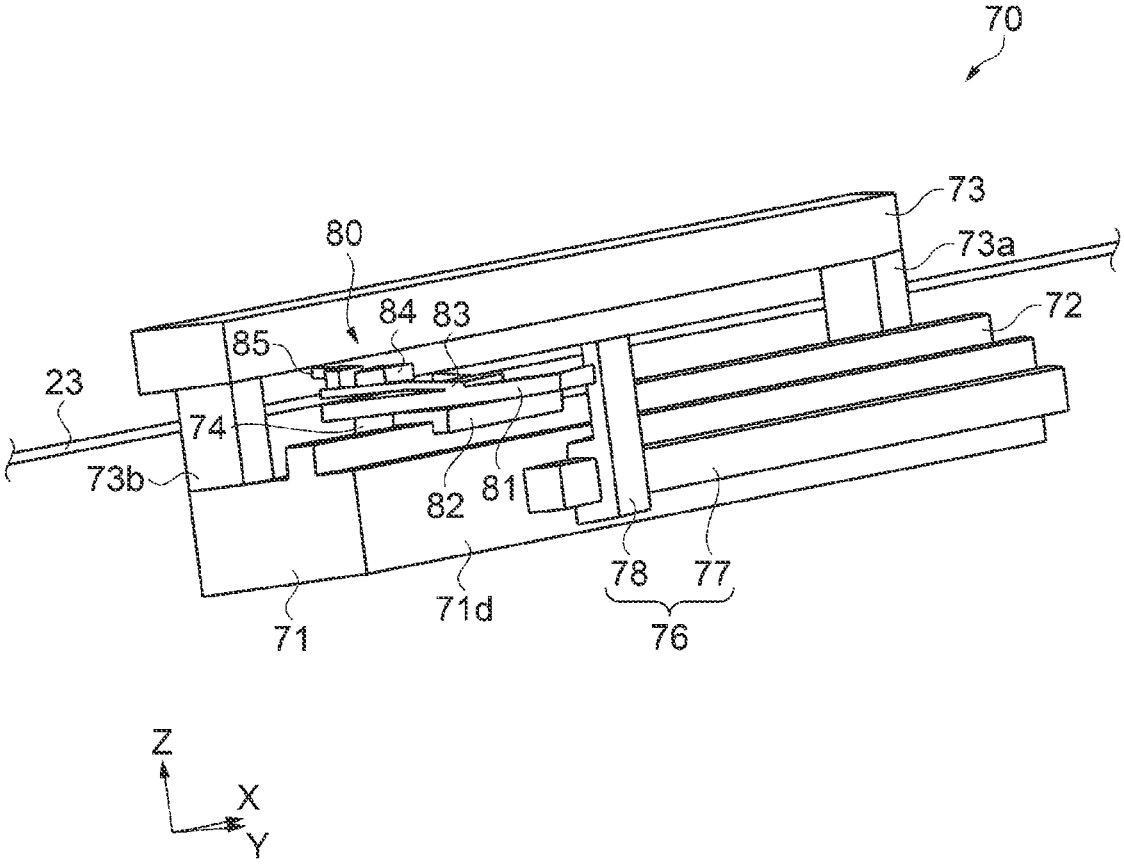
FIG. 3 is a perspective view showing configuration of a detection mechanism according to the first embodiment.
Figure 4:
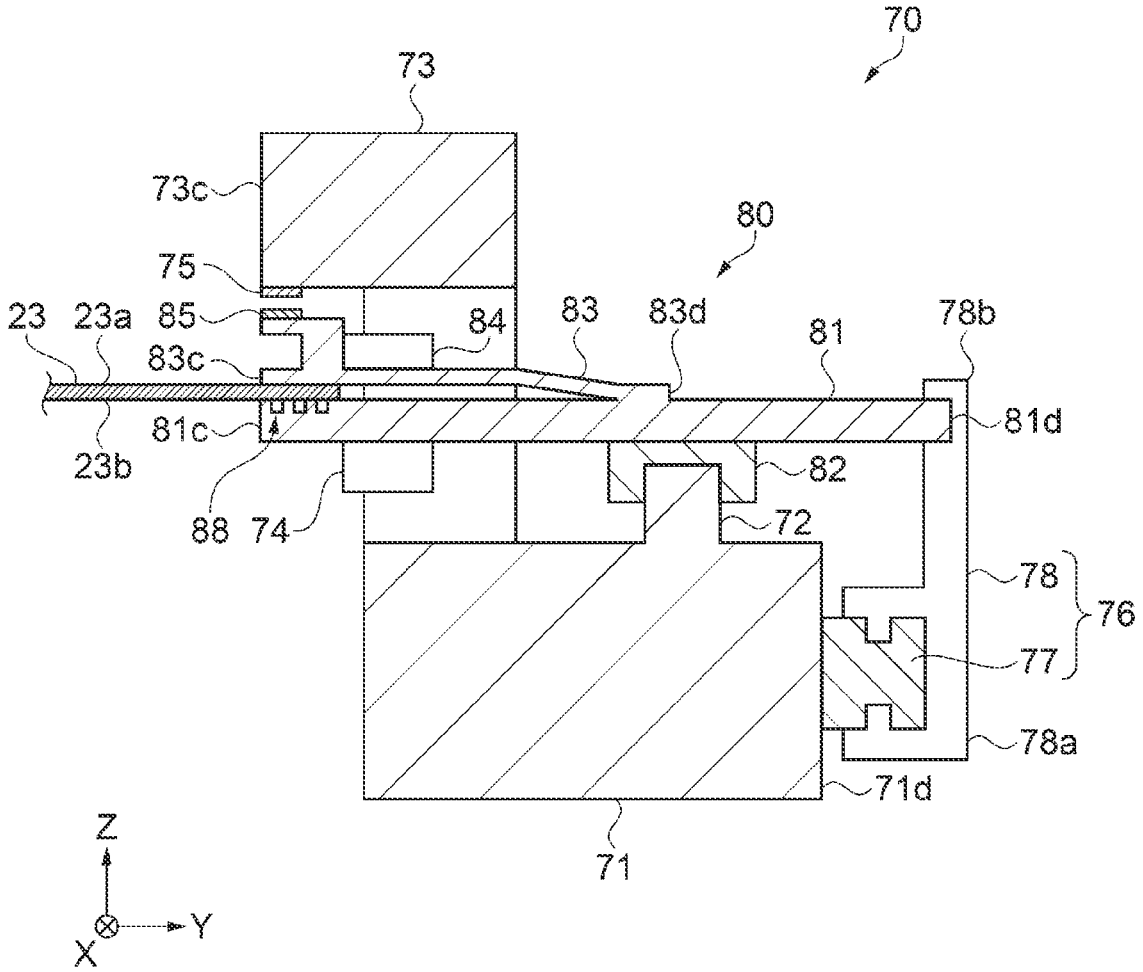
FIG. 4 is a cross sectional view showing configuration of the detection mechanism according to the first embodiment.

As shown in FIGS. 2, 3, and 4 (FIG. 4 is a cross sectional view taken along line A-A in FIG. 2), the detection mechanism 70 is provided upstream of the recording section 40, and is provided along one of the edges in the width direction (direction along the Y axis) of the transport belt 23. The detection mechanism 70 of the present embodiment is disposed on the +Y direction side of the transport belt 23. The detection mechanism 70 includes a rectangular parallelepiped base 71 that is elongated in the transport direction of the medium M, a scale attachment section 73 provided above the base 71, a gripping unit 80 that moves along a guide rail 72 that is provided on the base 71 and that extends in the direction along the X axis, a return section 76 that moves the gripping unit 80 upstream in the transport direction, and the like.

The scale attachment section 73 spans between column sections 73*a*, 73*b*, which are provided vertically at both ends in the longitudinal direction (along the X axis) of the base 71. The scale attachment section 73 has a protruding section that protrudes in the −Y direction in the form of an eave, and a part of the protruding section overlaps with the transport belt 23 in a plan view from the +Z direction. A scale section 75 is provided on the lower surface (surface on the −Z direction side) of the protruding portion of the scale attachment section 73 along the transport direction of the medium M. Marks (scale) are formed in the scale section 75 along the X axis. In the scale section 75 of the present embodiment, a magnetic scale is formed in which magnets having different polarities are alternately arranged.

The gripping unit 80 grips the transport belt 23 upstream of the recording section 40 in the transport direction. Here, it will be assumed for the moment that the drive roller 25 is provided upstream of the recording section 40 in the transport direction of the medium M, and the rotation roller 24 is provided downstream of the recording section 40. In this state, when the drive roller 25 is driven to rotate in order to move the gripping unit 80 in the gripping state together with the transport belt 23 in the transport direction, the transport belt 23 has elasticity, so there is a possibility that the transport belt 23 becomes slack between the drive roller 25 and the gripping unit 80 in a rotational moving direction of the transport belt 23. In contrast, in the present embodiment, the drive roller 25 is provided downstream of the recording section 40 in the transport direction of the medium M, and the rotation roller 24 is provided upstream of the recording section 40. Therefore, traction force of the drive roller 25 acts on the portion of the transport belt 23 moving at the upper side. Since the recording section 40 of the present embodiment is provided between the gripping unit 80 and the drive roller 25 in the direction of the rotational movement of the transport belt 23, the influence of slack in the transport belt 23 in the recording section 40 can be reduced. Accordingly, the transport accuracy of the medium M and the quality of an image formed on the medium are improved.

The gripping unit 80 includes a gripping substrate 81, a guide block 82, a reading section 85 capable of reading the magnetic scale of the scale section 75, and the like. The gripping substrate 81 has a rectangular plate shape that is elongated in the width direction (along the Y axis) of the transport belt 23. An end section 81*c* of the gripping substrate 81 on the −Y direction side substantially coincides with the side wall 73*c* of the scale attachment section 73 on the −Y direction side in a plan view from the −X direction and overlaps with the transport belt 23. An end section 81*d* of the gripping substrate 81 on the +Y direction side protrudes in the +Y direction from the side wall 71*d* on the +Y direction side of the base 71 in a plan view from the −X direction. The guide block 82 is provided on a bottom surface (surface on the −Z direction side) of the gripping substrate 81. In the guide block 82, a concave groove is formed that follows the shape of the guide rail 72, which protrudes in a convex shape, and that is open to the −Z direction side. By engaging the guide block 82 and the guide rail 72, the gripping unit 80 can reciprocate in a direction along the transport direction (a direction along the X axis).

The gripping unit 80 is at least partially constituted by an elastic member 83. Specifically, the elastic member 83 is provided on the upper surface (surface on the +Z direction side) side of the gripping substrate 81. The elastic member 83 has a rectangular plate shape that is shorter than the gripping substrate 81. An end section 83*d* of the elastic member 83 on the +Y direction side is joined to the gripping substrate 81 at the substantial center of the gripping substrate 81. An end section 83*c* of the elastic member 83 on the −Y direction side substantially coincides with the end section 81*c* of the gripping substrate 81 on the −Y direction side in a plan view from the −X direction. The end section 81*c* of the gripping substrate 81 and the end section 83*c* of the elastic member 83 have a gap slightly wider than the thickness of the transport belt 23. The gripping unit 80 is configured to be able to grip the transport belt 23 between the end section 81*c* of the gripping substrate 81 and the end section 83*c* of the elastic member 83 by the elastic force of the elastic member 83. The elastic member 83 is desirably carbon fiber or a composite material containing carbon fiber. Since carbon fiber has a lower specific gravity than metal material and is superior in strength, elastic modulus, and wear resistance, it is possible to secure the elasticity and strength required for the elastic member 83 of the gripping unit 80.

The gripping unit 80 is movable integrally with the reading section 85, and is configured to be switchable between a gripping state in which the gripping unit 80 grips the transport belt 23 and moves together with the transport belt 23, and a non-gripping state in which the gripping unit 80 does not grip the transport belt 23. Specifically, the gripping unit 80 includes a ferromagnet 84. The ferromagnet 84 is provided on an upper surface (surface on the +Z direction side) of the elastic member 83 that does not overlap with the transport belt 23 in a plan view from the +Z direction. As the ferromagnet 84, iron, nickel, cobalt, or the like can be used.

Further, a switching section 74, which switches the gripping unit 80 between the gripping state and the non-gripping state, is provided on the lower surface of the gripping substrate 81 of the gripping unit 80 at a position facing the ferromagnet 84. The switching section 74 includes an electromagnet, and the ferromagnet 84 is attracted toward the switching section 74 (electromagnet) by magnetic force generated when current flows through the electromagnet. At this time, the elastic member 83 is elastically deformed to the gripping substrate 81 side, and the transport belt 23 is gripped between the gripping substrate 81 and the elastic member 83 by the elastic force. As a result, the gripping unit 80 is changed from the non-gripping state to the gripping state. Further, when the current flowing through the electromagnet is interrupted, the state of the gripping unit 80 is changed from the gripping state to the non-gripping state. Therefore, the switching section 74 has a function of switching the gripping unit 80 from one to the other of the gripping state and the non-gripping state by using the elasticity of the elastic member 83. Since the state of the gripping unit 80 is changed by a simple configuration of the electromagnet of the switching section 74 and the ferromagnet 84, the switching section 74 and the gripping unit 80 can be miniaturized. The magnetic force generated by the electromagnet increases as the magnitude of the current flowing through the electromagnet increases. Therefore, the force (gripping force) with which the gripping unit 80 grips the transport belt 23 when the state of the gripping unit 80 is the gripping state, can be changed by adjusting the current flowing through the electromagnet. The magnitude of the current flowing through the electromagnet may be controlled by the control section 1. That is, the control section 1 may control the force with which the gripping unit 80 grips the transport belt 23.

The reading section 85 is provided on the upper surface of the end section 83*c* of the elastic member 83 and at a position facing the scale section 75. The reading section 85 includes an element (for example, a Hall element or an MR element) that converts a change of a magnetic field into an electric signal, and detects a relative movement amount with respect to the scale section 75. The reading section 85 according to the present embodiment is provided on a base to be disposed close to the scale section 75. Since the reading section 85 is configured to move integrally with the gripping unit 80, the movement amount of the transport belt 23 can be detected when the gripping unit 80 in the gripping state moves together with the transport belt 23.

The return section 76 moves the gripping unit 80 in the non-gripping state in a direction opposite to the transport direction. The return section 76 includes a moving lever 78 and a lever moving section 77 that reciprocates the moving lever 78 along the transport direction. The lever moving section 77 has a rectangular parallelepiped shape that is elongated in the transport direction, and is fixed to the side wall 71*d* on the +Y direction side of the base 71. An upper surface (surface on the +Z direction side) and a lower surface (surface on the −Z direction side) of the lever moving section 77 each have a concave-shaped guide groove extending in the transport direction.

The moving lever 78 includes a base 78*a* having convex projections following the shapes of the guide grooves in the upper surface and in the lower surface of the lever moving section 77 and a long handle section 78*b* extending from the base 78*a* in the vertical direction (+Z direction). The moving lever 78 is configured to be able to reciprocate along the guide grooves in the upper surface and in the lower surface of the lever moving section 77. The lever moving section 77 includes a moving mechanism (not shown) that reciprocates the moving lever 78 in the transport direction. As the moving mechanism, for example, an air cylinder or the like can be adopted. When the moving lever 78 is moved to upstream in the transport direction by the lever moving section 77, the long handle section 78*b* of the moving lever 78 and the gripping substrate 81 of the gripping unit 80 contact on each other, and the gripping unit 80 in the non-gripping state is moved in the direction opposite to the transport direction and returned to upstream in the transport direction. Accordingly, the gripping unit 80 in the gripping state can be repeatedly moved together with the transport belt 23, and the movement amount of the transport belt 23 can be repeatedly detected by the reading section 85.

Further, the gripping unit 80 is provided with at least one cling section 88 configured to clingingly attract the transport belt 23. The cling section 88 is configured to be capable of changing a state from one to the other of a cling state in which the transport belt 23 is clingingly attracted and a non-cling state in which the transport belt 23 is not clingingly attracted. The cling section 88 is provided on at least one of the elastic member 83 (first contact section), which contacts the front surface 23*a* of the transport belt 23, or the gripping substrate 81 (second contact section), which contacts the back surface 23*b* of the transport belt 23. The cling section 88 of the present embodiment is provided on the gripping substrate 81. Specifically, the cling section 88 includes an opening section provided on the +Z direction end surface of the end section 81*c* of the gripping substrate 81 and a cling section (for example, a pump or a fan) for clingingly attracting outside air into the gripping substrate 81 through the opening section. By drive the cling section, a clinging attraction force in the −Z direction is generated with respect to the +Z direction end surface of the end section 81*c*. As a result, the transport belt 23 can be clingingly attracted against the gripping substrate 81 and into in the cling state. On the other hand, by stopping the drive of the cling section, the clinging attraction force is released, and the non-cling state can be obtained. The cling section 88 may be provided on the elastic member 83 side or may be provided on both the elastic member 83 and the gripping substrate 81. Further, the cling section 88 may be an electrostatic clinging attraction mechanism utilizing static electricity.

Each operation of the cling state and the non-cling state of the cling section 88 is synchronized with each operation of the gripping state and the non-gripping state of the switching section 74. That is, in the gripping unit 80, the gripping state and the cling state of the transport belt 23 are executed simultaneously. Accordingly, the transport belt 23 can be reliably gripped by the clinging attraction force of the cling section 88 in addition to the gripping force by the magnetic force. On the other hand, the non-gripping state and the non-cling state of the transport belt 23 are executed at the same time.

Here, in the transport device 110 (recording apparatus 100), it is desirable that the transport belt 23 be held at a predetermined tension by the rotation roller 24 and the drive roller 25. This is because, when the transport belt 23 does not have the predetermined tension, the transport accuracy of the medium M decreases, and may cause a decrease in image quality. However, there is a possibility that the tension deviates from the predetermined tension due to deterioration or hardening of the transport belt 23 with time of use, influence of heat by the drying unit 27, fluctuation of a stretching mechanism of the transport belt 23, or the like.

Therefore, the detection mechanism 70 of the present embodiment is configured to be able to detect the magnitude of the tension of the transport belt 23. That is, in the transport device 110 (recording apparatus 100) according to the present embodiment, the detection mechanism 70, which detects the movement amount of the transport belt 23, can also be used as a mechanism that detects the magnitude of the tension of the transport belt 23.

The detection mechanism 70 of this embodiment detects the vibration state of the transport belt 23 at the end of the transport operation, as the magnitude of the tension of the transport belt 23. In the present embodiment, vibration in a direction along the transport direction of the transport belt 23 (direction along the X axis) is detected.

Specifically, the vibration state of the transport belt 23 when a transport operation, in which the medium M is transported while the transport belt 23 is gripped by the gripping unit 80, ends is detected by the reading section 85 reading the vibration of the gripping unit 80 in the gripping state from the scale section 75. With this configuration, it is possible use inertia from the mass of the gripping unit 80 in the gripping state, to apply to the transport belt 23 a force or acceleration sufficient to vibrate the transport belt 23, and it is easy to detect the vibration of the transport belt 23.

In addition, since the gripping state and the cling state of the transport belt 23 are synchronized by the switching section 74 and the cling section 88, when the gripping unit 80 vibrates, the gripping substrate 81 of the gripping unit 80 is suppressed from slipping with respect to the transport belt 23 due to the inertia of the gripping unit 80, and the tension due to the vibration of the gripping unit 80 can be accurately detected.

In the present embodiment, the configuration in which the reading section 85 moves integrally with the gripping unit 80 and the scale section 75 is fixed has been described, but a configuration in which the scale section 75 moves integrally with the gripping unit 80 and the reading section 85 is fixed may be employed.

In addition, in the present embodiment, a so called magnetic encoder that determines a relative movement amount between the scale section 75 and the reading section 85 by a change of the magnetic field is given as an example, but an optical encoder that determines a movement amount by an optical change may be used.

Further, the control section 1 may increase the gripping force of the gripping unit 80 while the detection mechanism 70 detects the vibration state of the transport belt 23. Accordingly, the gripping substrate 81 of the gripping unit 80 is further suppressed from slipping with respect to the transport belt 23, and the tension due to the vibration of the gripping unit 80 can be more accurately detected. According to such control, as compared with the case where the holding force is large during periods other than the period when the detection mechanism 70 detects the vibration state of the transport belt 23, it is possible to suppress deformation of the transport belt 23 due to a large holding force from remaining and reduction in the service life of the transport belt 23.

Figure 5:
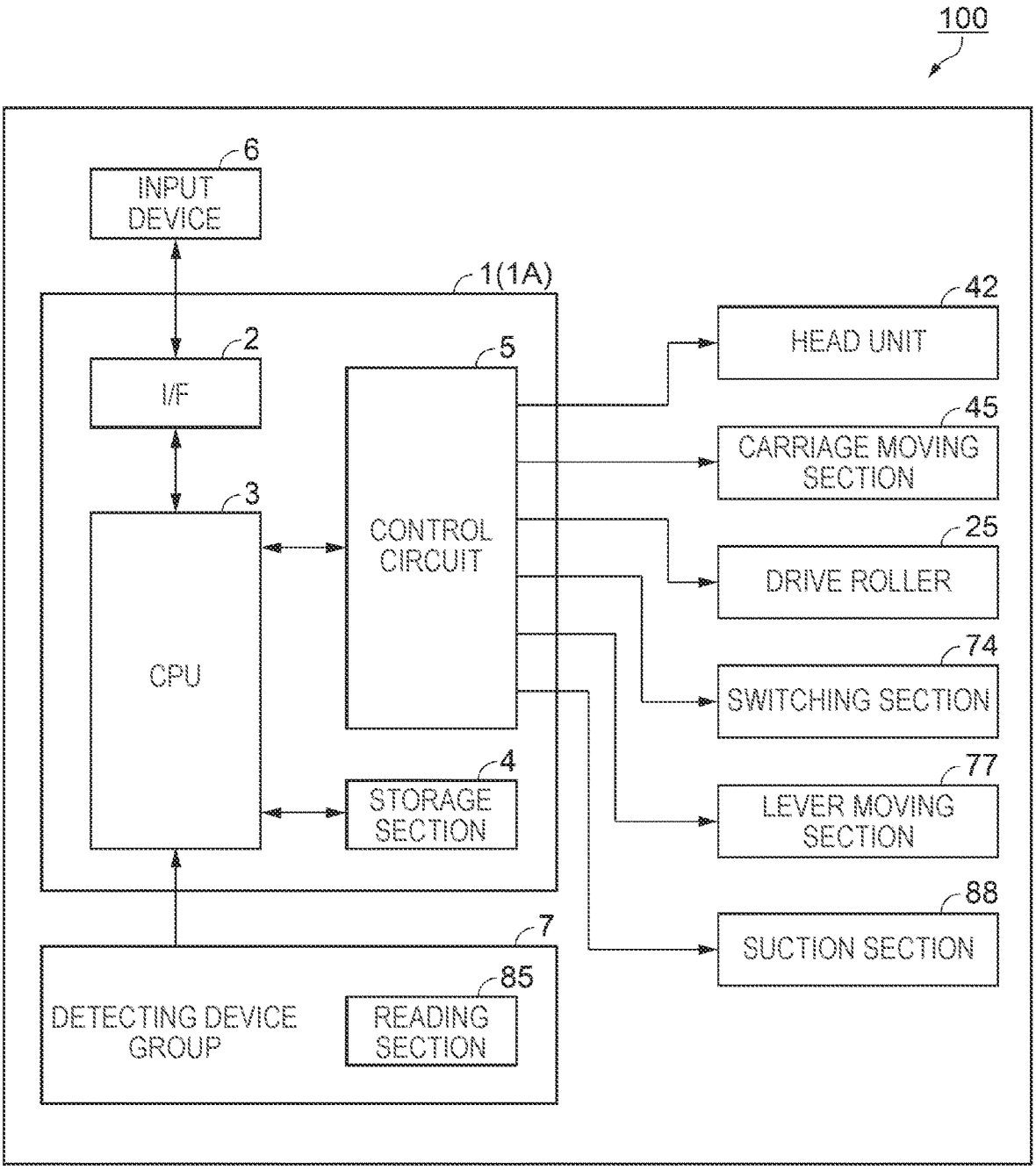
FIG. 5 is a block diagram showing control configuration of the recording apparatus according to the first embodiment.

As shown in FIG. 5, the recording apparatus 100 includes an input device 6 configured to input recording conditions and the like, and the control section 1 configured to control each unit of the recording apparatus 100. As the input device 6, various personal computers, tablet type terminals, portable terminals, and the like can be used. The input device 6 may be provided separately from the recording apparatus 100.

The control section 1 includes an interface section (I/F) 2, a central processing unit (CPU) 3, a storage section 4, and a control circuit 5. The interface section 2 transmits and receives data between the input device 6 that handles input signals and images and the control section 1. The CPU 3 is an arithmetic processing device for performing input signal processing from various ones of a detecting device group 7 including the reading section 85, and control of recording operations of the recording apparatus 100. For example, the CPU 3 calculates, by the input signal output from the reading section 85 and input to the CPU 3, the movement amount of the transport belt 23 and the magnitude of the tension of the transport belt 23.

The storage section 4 is a storage medium for securing an area for storing the program of the CPU 3, a work area, and the like, and has a storage element such as a random access memory (RAM) and an electrically erasable programmable read only memory (EEPROM).

The control section 1 controls drive of the ejection head included in the head unit 42 by a control signal output from the control circuit 5, and causes the ink to be ejected toward the medium M. The control section 1 controls drive of the motor provided in the carriage moving section 45 according to the control signal output from the control circuit 5 to reciprocate the carriage 43 on which the head unit 42 is mounted in a main scanning direction (direction along the Y axis). The control section 1 controls drive of the motor provided at the drive roller 25 by the control signal output from the control circuit 5 to rotationally move the transport belt 23. Accordingly, the medium M supported on the transport belt 23 is moved in the transport direction (+X direction).

An image or the like is formed on the medium M by a recording operation (intermittent operation) in which the control section 1 alternately repeats a main scan, in which the control section 1 controls the carriage moving section 45 and the head unit 42 to move the head unit 42 (carriage 43) while ejecting ink from the ejection head, and a sub scan, in which the control section 1 controls the drive roller 25 to transport the medium M in the transport direction.

The control section 1 switches the gripping unit 80 between the gripping state and the non-gripping state by using the control signal output from the control circuit 5 to control current flowing through the electromagnet provided in the switching section 74. The control section 1 uses the control signal output from the control circuit 5 to control the moving mechanism of the lever moving section 77 to reciprocate the moving lever 78 along the transport direction. The control section 1 controls the cling section of the cling section 88 to switch between a cling state and a non-cling state with respect to the transport belt 23. In addition, the control section 1 controls units which are not shown.

Here, the configuration of the control section 1 relating to the tension of the transport belt 23 will be described.

The control section 1 determines the magnitude of the tension of the transport belt 23 based on the vibration state of the transport belt 23 detected by the detection mechanism 70 when the transport operation ends. In the present embodiment, the vibration state of the transport belt 23 when the transport operation ends is detected by the reading section 85 reading the vibration of the gripping unit 80 in the gripping state. That is, the control section 1 determines the magnitude of the tension of the transport belt 23 based on the residual vibration of the transport belt 23 when the transport operation ends. Then, the residual vibration is detected by the detection mechanism 70 that detects the movement amount of the transport belt 23 during intermittent operation.

Further, when a path in which the transport belt 23 moves is defined as a movement path, the movement path includes a transport path in which the medium M is supported and the medium M is transported, and a non-transport path that does not constitute the transport path. The transport path is a path along which the front surface 23*a* of the transport belt 23 and the head unit 42 face each other, and the non-transport path is a path along which the front surface 23*a* of the transport belt 23 and the blade 55 of the washing unit 50 face each other. Then, the gripping state by the gripping unit 80 is a state of gripping the transport belt 23 that moves in the transport path of the movement path. The control section 1 determines the magnitude of the tension of the transport belt 23 based on the vibration state of the transport belt 23 moving in the transport path. As a result, it is possible to detect the tension of the transport path, which influences the transport accuracy of the medium M more than does the non-transport path.

Figure 6:
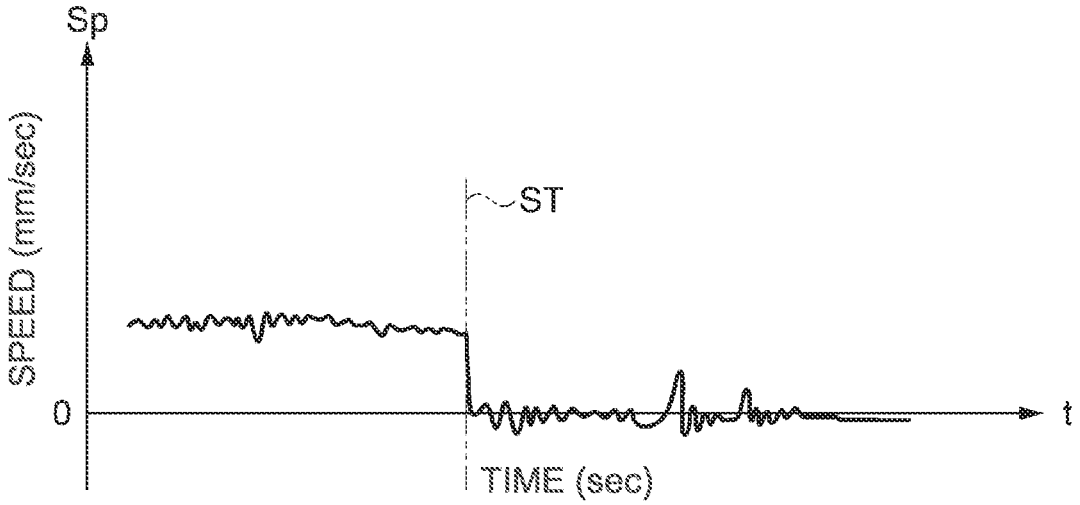
FIG. 6 is a graph showing example of a detection result of tension of a transport belt according to the first embodiment.

FIG. 6 shows an example of the detection result of the tension of the transport belt 23. In FIG. 6, the vertical axis represents speed Sp (mm/sec) of the transport belt 23, and the horizontal axis represents time t (sec). Further, the reference time ST shown in FIG. 6 indicates a time point at which the transport operation of the transport belt 23 ends.

As shown in FIG. 6, until the reference time ST is reached, the transport belt 23 is in the transport operation, and the speed of the transport belt 23 is detected on the positive side.

Thereafter, when the reference time ST is reached, the transport operation of the transport belt 23 ends. When the transport operation of the transport belt 23 ends, the transport belt 23 stops, but inertia acts due to the mass of the gripping unit 80 that grips the transport belt 23, and the transport belt 23 vibrates in a direction along the transport direction (direction along the X-axis). As a result, as shown in FIG. 6, the speed of the transport belt 23 is detected on the plus side and the minus side after the reference time ST. That is, the residual vibration of the transport belt 23 is detected.

The control section 1 calculates the amplitude, the frequency, and the like based on the residual vibration of the transport belt 23 for a predetermined elapsed period (for example, 0.1 second to 0.5 seconds) from the reference time ST.

Then, the control section 1 determines the magnitude of the tension of the transport belt 23 based on the calculated amplitude and frequency. For example, the control section 1 compares the calculated amplitude and frequency with specified values, and determines whether or not the tension of the transport belt 23 is acceptable. It should be noted that the specified values are the amplitude and the frequency at the time of shipment of the transport device 110, at the time that the transport belt 23 is adjusted, or the like. That is, the tension of the transport belt 23 is a value in a normal state. The specified values are stored in the storage section 4. Further, the specified values have a certain allowable range.

When the calculated amplitude is larger than a specified value or when the calculated frequency is smaller than a specified value, the control section 1 determines that the tension of the transport belt 23 is low. On the other hand, when the calculated amplitude is smaller than the specified value or when the calculated frequency is larger than the specified value, the control section 1 determines that the tension of the transport belt 23 is high. That is, the state of the tension of the transport belt 23 can be estimated by comparing the calculated amplitude and frequency with specified values.

Next, a control method of the recording apparatus 100 will be described. Specifically, the control method for determining the tension of the transport belt 23 in a series of recording operations (intermittent operations) will be described.

Figure 7A:
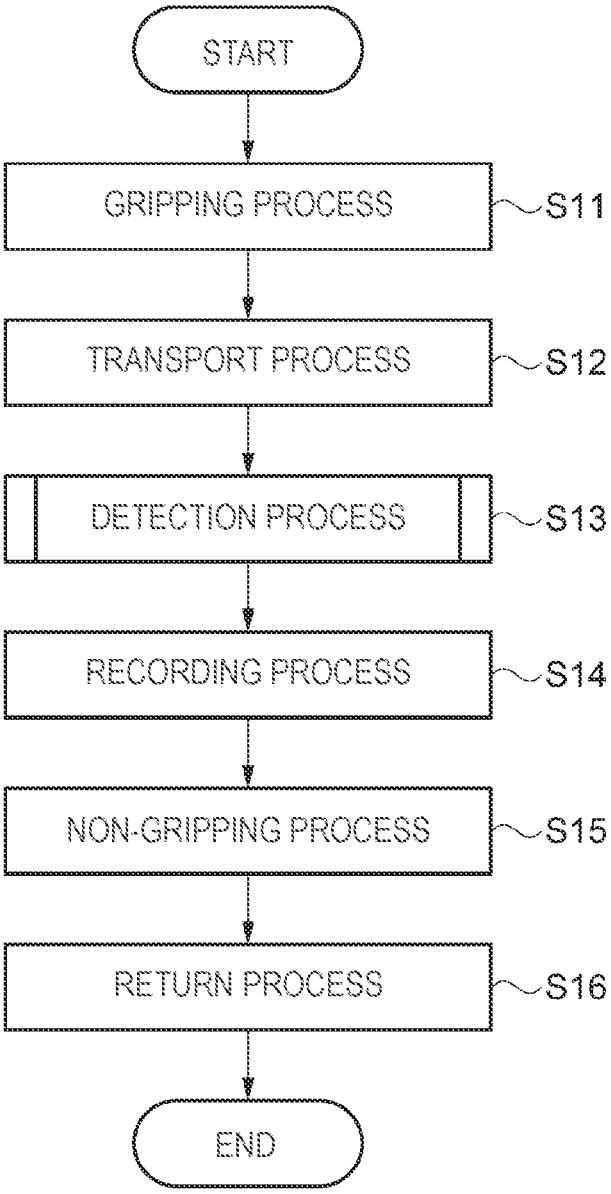
FIG. 7A is a flowchart showing a control method of the recording apparatus according to the first embodiment.

As shown in FIG. 7A, in step S11 (gripping process), when the control section 1 receives print data for recording an image on the medium M from the input device 6 and stores the print data in the storage section 4, the control section 1 causes the gripping unit 80 to grip the transport belt 23. The control section 1 causes a current to flow in the electromagnet of the switching section 74 to cause the electromagnet to generate a magnetic force. As a result, the gripping unit 80 is in the gripping state and grips the transport belt 23. Further, the cling section 88 is driven to clingingly attract the transport belt 23 to the gripping substrate 81.

Next, in step S12 (transport process), the control section 1 controls the drive roller 25 to transport the gripping unit 80 in the gripping state together with the transport belt 23. The control section 1 stops the rotational movement of the transport belt 23 when, in accordance with the movement amount detected by the reading section 85, the gripping unit 80 moves from a first position to a second position located downstream of the first position in the transport direction. The interval between the first position and the second position is the line feed amount during the printing operation. In the first transport process, the gripping unit 80 is transported to a predetermined position where the recording process is started.

Figure 7B:
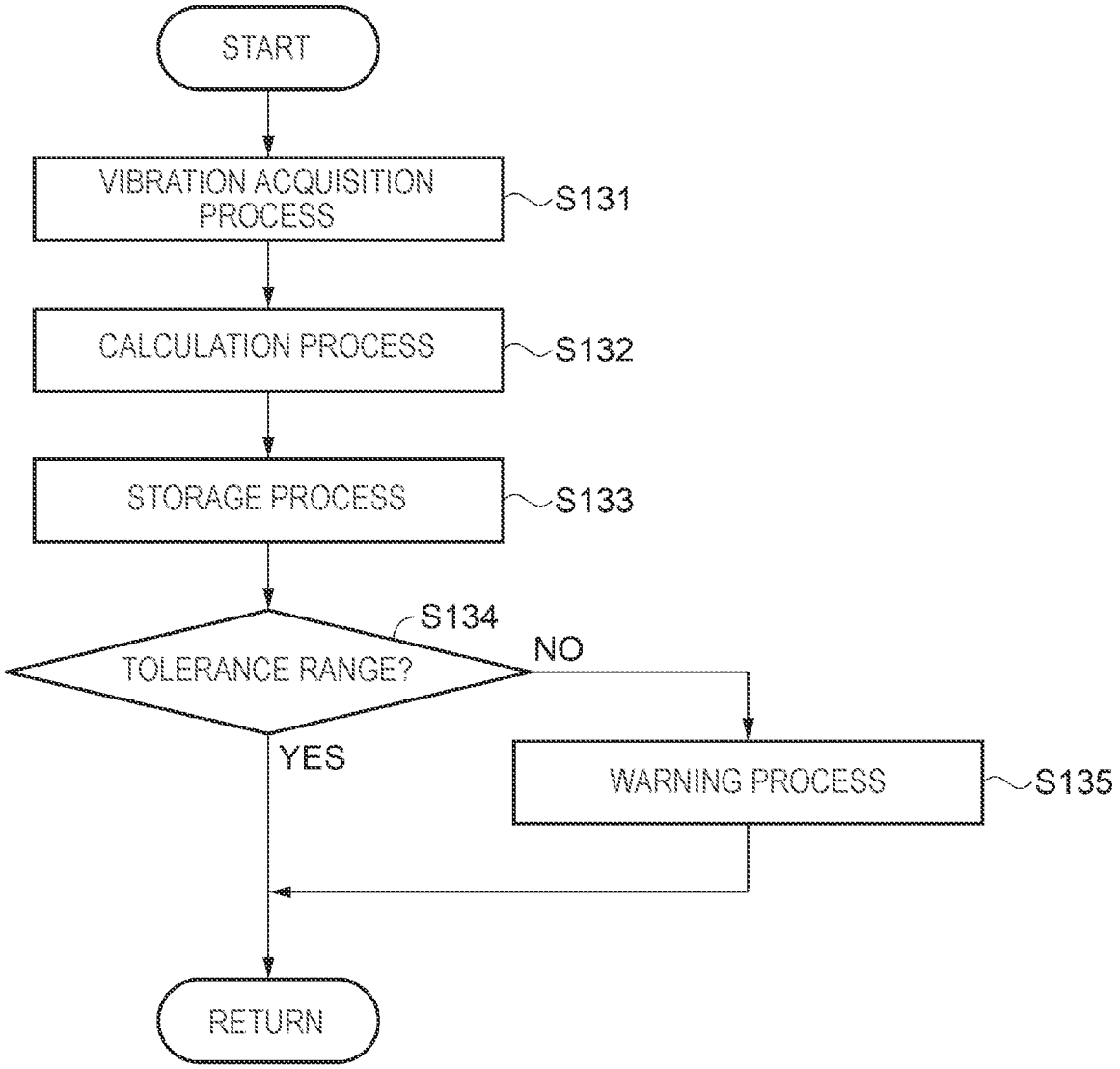
FIG. 7B is a flowchart showing the control method of the recording apparatus according to the first embodiment.

Next, in step S13 (detection process), the control section 1 determines the magnitude of the tension of the transport belt 23. FIG. 7B shows a detection processing method.

In step S131 (vibration acquisition process), the control section 1 acquires the residual vibration (minute movement amounts) detected by the reading section 85.

Next, in step S132 (calculation process), the control section 1 calculates the amplitude or the frequency based on the acquired residual vibration.

Next, in step S133 (storage process), the control section 1 stores the calculated amplitude or frequency in the storage section 4. In addition, the control section 1 stores date and time information when the amplitude or frequency was calculated and attribute information of the recording apparatus 100 and the transport device 110 together in the storage section 4. The tension information on the tension of the transport belt 23 stored in the storage section 4 can be output to the input device 6. Therefore, the user can monitor a tension state of the transport belt 23, and can estimate the tension state of the transport belt 23 from the stored tension information.

In step S131, the control section 1 may increase the gripping force of the gripping unit 80.

Next, in step S134 (determination process), the control section 1 compares the calculated amplitude and frequency with the specified values to determine whether or not the tension of the transport belt 23 is within a tolerance range.

When the tension of the transport belt 23 is within the tolerance range (YES), the process proceeds to step S14, and when the tension of the transport belt 23 is not within the tolerance range (NO), the process proceeds to step S135.

In step S135 (warning process), for example, the fact that the tension of the transport belt 23 is out of the tolerance range is displayed on the input device 6, and a warning is issued to the user. Based on the warning, the user can appropriately perform adjustment of the transport belt 23, contact with a maintenance service provider, and the like.

Next, in step S14 (recording process), the control section 1 controls the head unit 42 and the carriage moving section 45 to discharge the ink from the head unit 42 toward the medium M while moving the carriage 43 on which the head unit 42 is mounted in the width direction (direction along the Y-axis), which intersects the transport direction of the medium M.

Next, in step S15 (non-gripping process), the control section 1 cuts off the current flowing to the electromagnet of the switching section 74 to demagnetize the magnetic force of the electromagnet. In addition, the drive of the cling section 88 is stopped. As a result, the gripping unit 80 is in the non-gripping state.

Next, in step S16 (return process), the control section 1 controls the lever moving section 77 to move the moving lever 78, which is standing by at a predetermined position downstream of the gripping unit 80 in the transport direction, upstream in the transport direction. Accordingly, the gripping unit 80 and the moving lever 78 contact each other, and the gripping unit 80, which is in the non-gripping state and is located at the second position, is returned to the first position. Accordingly, the gripping unit 80 in the gripping state can be repeatedly moved from the first position to the second position together with the transport belt 23. Afterward, the moving lever 78 is moved to downstream of the second position in the transport direction and stands by at the predetermined position. Therefore, in step S12, when the gripping unit 80 in the gripping state moves together with the transport belt 23, the moving lever 78 of the return section 76 is separated from the gripping unit 80, so that it is possible to suppress the return section 76 from applying a load to the rotational drive of the transport belt 23. Note that step S15 and step S16 may be executed substantially simultaneously with step S14.

Thereafter, steps S11 to step S16 are repeatedly executed until processing of print data transmitted from the input device 6 is completed.

As described above, according to the present embodiment, the detection mechanism 70 for detecting the movement amount of the transport belt 23 can also be used as a detection unit for detecting the magnitude of the tension of the transport belt 23. Accordingly, it is not necessary to separately provide a sensor for detecting the magnitude of the tension of the transport belt 23, and it is possible to suppress the structure of the transport device 110 (recording apparatus 100) from being complicated.

In addition, a special control operation for detecting the tension of the transport belt 23 is not necessary, and can be executed in the process of a series of recording operations for detecting the movement amount of the transport belt 23, and the control configuration of the transport device 110 (recording apparatus 100) can be simplified. Further, by monitoring the residual vibration applied to the transport belt 23 in the series of recording operations, the tension state of the transport belt 23 can be estimated. In addition, by monitoring the transport belt 23, for example, it is possible to use the monitoring for analyzing the states of the medium transport section 20, the medium contact section 60, the washing unit 50, and the like which are highly related to the operation of the transport belt 23.

In the control method of the recording apparatus 100, the recording process (step S14) has been described in the series of recording operations, but the present disclosure is not limited thereto, and the recording process may be performed using the transport device 110 by itself. In this way, the magnitude of the tension of the transport belt 23 can be determined without being influenced by the medium transport section 20, the washing unit 50, and the like. Further, the tension state of the transport belt 23 can be estimated by comparing the transport device 110 with the specified value at the time of shipment from the factory.

Further, information such as a use history of the drying unit 27, an operation history of the recording section 40, and a use time of the transport belt 23 may be included as the information of the tension stored in the storage section 4 in step S133 of the method of controlling the recording apparatus 100. By combining information that has high influence on the tension of the transport belt 23, it is possible to improve the estimation accuracy of the tension state of the transport belt 23.

Further, the tension information stored in the storage section 4 in step S133 may be transmitted to an external maintenance service providing device (for example, a server device) via a communication circuit. In this way, the user can receive appropriate services.

Further, as long as the transport belt 23 can be gripped, the structure of the gripping unit 80 is not limited. For example, the gripping unit 80 may have a scissors like configuration including a pair of arm members pivotable about at least one rotation axis.

In the present embodiment, the configuration of the recording apparatus 100 having the transport device 110 is described as an example, but the present disclosure is not limited to this, and the configuration of only the transport device 110 may be employed. That is, the transport device 110 includes the transport belt 23, the detection mechanism 70, and the control section 1 configured to determine the magnitude of the tension of the transport belt 23. Also in this manner, the same effects as described above can be obtained.

2. Second Embodiment

Next, a second embodiment will be described. Note that the same configuration as in the first embodiment is denoted by the same reference numerals, and redundant description will be omitted.

A transport device 110A of the present embodiment includes the transport belt 23 that alternately repeats the transport operation that transports the medium M and the non-transport operation that does not transport the medium M, the detection mechanism 70 that detects the movement amount of the transport belt 23 in the transport operation, the drive roller 25 that is provided downstream of the detection mechanism in the transport direction in which the medium M is transported and that rotationally moves the transport belt 23, and a control section 1A.

The control section 1A of this embodiment determines the magnitude of the tension of the transport belt 23 based on the difference between the target speed of the transport belt 23 and the detected speed of the transport belt 23 detected by the detection mechanism 70.

Figure 8:
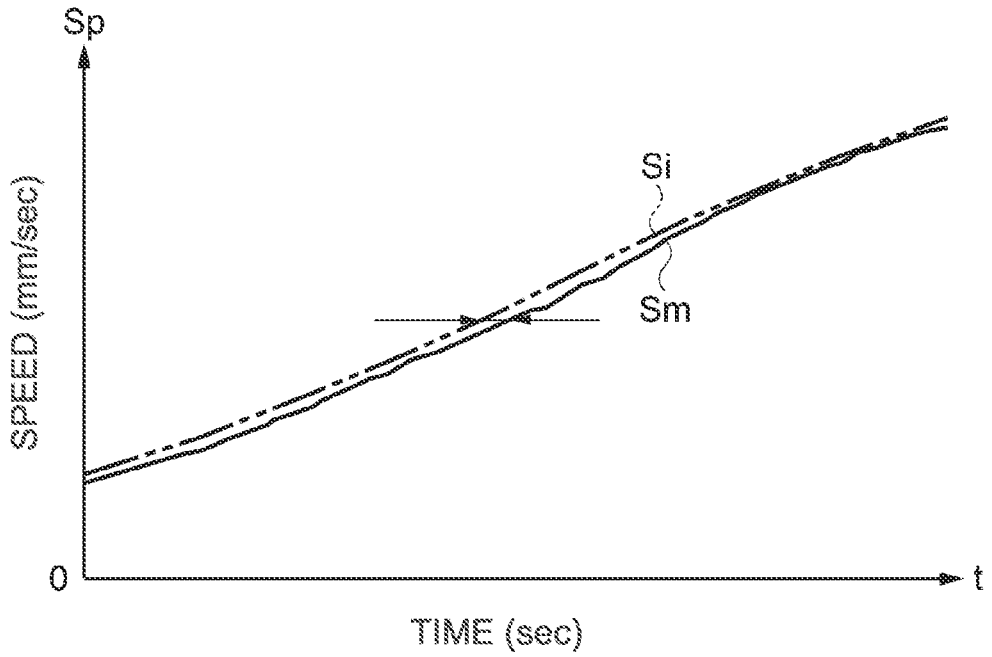
FIG. 8 is a graph showing example of a detection result of a tension of a transport belt according to a second embodiment.

FIG. 8 shows example of the detection result of the tension of the transport belt 23. In FIG. 8, the vertical axis represents speed Sp (mm/sec) of the transport belt 23, and the horizontal axis represents time t (sec). Further, a two dot chain line in FIG. 8 indicates a target speed (commanded speed) Si which is the commanded moving speed of the transport belt 23, and a solid line indicates a detected speed (actual measurement value) Sm of the transport belt 23 detected by the detection mechanism 70.

In this embodiment, the control section 1A drives the drive roller 25 based on the target speed Si in a gripping state in which the gripping unit 80 grips the transport belt 23, to accelerate movement of the transport belt 23. Further, the detection mechanism 70 detects the moving speed of the transport belt 23 during the accelerating moving of the transport belt 23. Thus, as shown in FIG. 8, the actual measurement value Sm is detected, and a difference between the target speed Si and the actual measurement value Sm can be calculated as a phase difference.

In the present embodiment, because the drive roller 25 that rotationally moves the transport belt 23 is provided downstream of the detection mechanism 70 in the transport direction, it is possible to apply to the transport belt 23 a tensile force for detecting the phase difference.

The control section 1A determines the magnitude of the tension of the transport belt 23 based on the phase difference between the target speed Si and the actual measurement value Sm. Specifically, the control section 1 determines whether or not the tension of the transport belt 23 is applicable based on the magnitude of the calculated phase difference.

For example, when the magnitude of the phase difference is larger than a specified value, the control section 1A determines that the tension of the transport belt 23 is low. In this case, it is considered that the elongation of the transport belt 23 is large, and when the drive roller 25 rotates, the transport belt 23 cannot follow the drive roller 25, and the rotation speed is delayed. Note that the specified value is a phase difference between the target speed Si and the actual measurement value Sm at the time of shipment of the transport device 110 or when adjustment or the like of the transport belt 23 is performed. That is, the tension of the transport belt 23 is a value in a normal state. In this manner, it becomes possible to determine whether or not the tension of the transport belt 23 is allowable and to estimate the tension state.

As described above, according to the present embodiment, the detection mechanism 70 for detecting the movement amount of the transport belt 23 can also be used as a unit for detecting the magnitude of the tension of the transport belt 23. Accordingly, it is not necessary to separately provide a sensor or the like for detecting the magnitude of the tension of the transport belt 23, and it is possible to suppress the structure of the transport device 110A from being complicated.

Although the transport device 110A has been described in the present embodiment, a configuration of a recording apparatus including the transport device 110A and the recording section 40 may be employed. Also in this manner, the same effects as described above can be obtained.

3. Third Embodiment

Next, a third embodiment will be described. Note that the same configuration as in the first embodiment is denoted by the same reference numerals, and redundant description will be omitted.

Figure 9A:
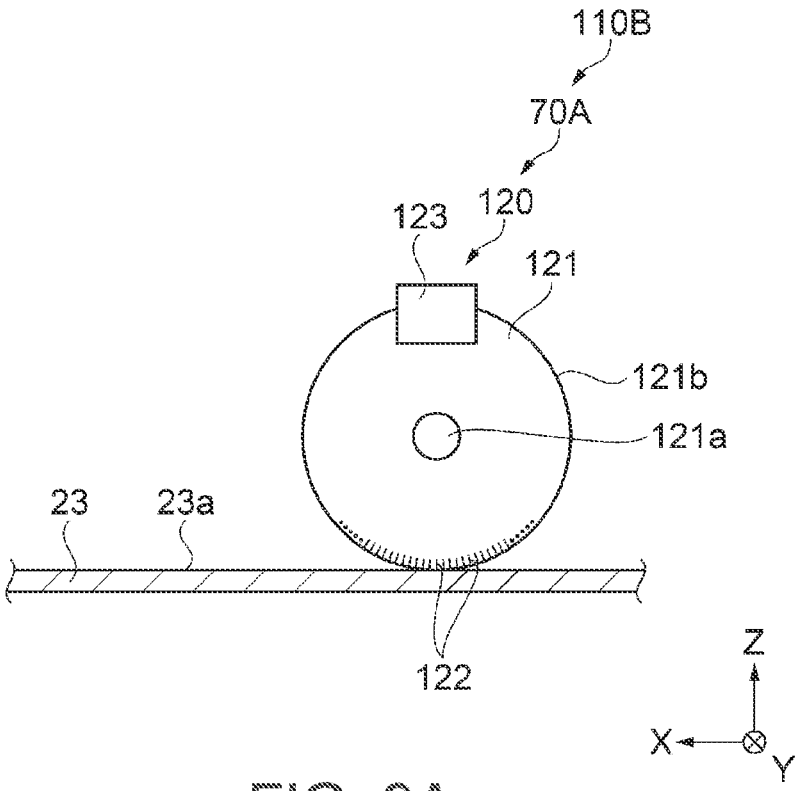
FIG. 9A is a schematic diagram showing configuration of a detection mechanism according to a third embodiment.
Figure 9B:
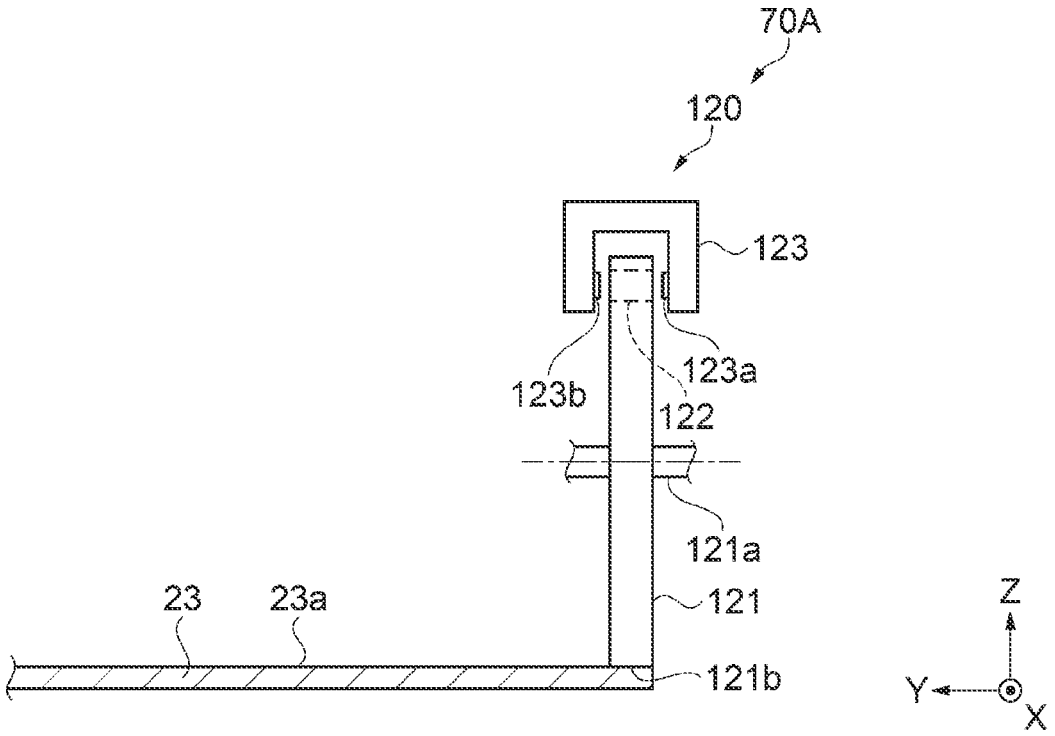
FIG. 9B is a schematic diagram showing configuration of the detection mechanism according to the third embodiment.

As shown in FIGS. 9A and 9B, a transport device 110B of the present embodiment includes rollers (the rotation roller 24 and the drive roller 25) around which the transport belt 23 is wound, a detection mechanism 70A, and the control section 1.

The detection mechanism 70A includes a rotary encoder 120 provided in a state in which a position with respect to the rollers (the rotation roller 24 and the drive roller 25) is fixed.

The rotary encoder 120 includes a disk section 121 that can be rotated by the transport belt 23 by contacting the front surface 23*a* of the transport belt 23, and a reading section 123 that can read marks (scale) 122 formed on the disk section 121.

The disk section 121 is formed in a disk shape, and a plurality of marks 122 for position detection are formed along its peripheral edge at equal intervals over the whole periphery. The marks 122 are slits that penetrate through the disk section 121 in a direction along the Y axis. A shaft 121*a* extending along the Y axis is provided at the center of the disk section 121. The shaft 121*a* is supported by a bearing (not shown) fixed at a predetermined position. An outer peripheral surface 121*b* of the disk section 121 is in contact with the front surface 23*a* of the transport belt 23, and the disk section 121 rotates around the shaft 121*a* at the predetermined fixed position in accordance with the transport operation of the transport belt 23.

The reading section 123 is arranged at a position through which a peripheral edge section of the disk section 121 passes. Specifically, the reading section 123 includes a light emitting section 123*a* (for example, a light emitting diode) and a light receiving section 123*b* (for example, a phototransistor) facing each other via the peripheral edge section of the disk section 121. Then, when the light emitted from the light emitting section 123*a* passes through the marks 122 of the disk section 121 and is received by the light receiving section 123*b*, an electric signal is output from the light receiving section 123*b*. As a result, the movement amount of the transport belt 23 is detected.

Further, the control section 1 of this embodiment determines the magnitude of the tension of the transport belt 23 based on the vibration state of the transport belt 23 detected by the detection mechanism 70A when the transport operation ends. Specifically, the vibration state of the transport belt 23 at the end of the transport operation is detected by the reading section 123 reading the marks 122 formed in the disk section 121. That is, the control section 1 determines the magnitude of the tension of the transport belt 23 based on the residual vibration of the transport belt 23 when the transport operation ends. The detection result of the tension of the transport belt 23 is similar to that in FIG. 6. Then, the residual vibration is detected by the detection mechanism 70A that detects the movement amount of the transport belt 23 during intermittent operation.

Configurations other than the rotation roller 24, the drive roller 25, and the detection mechanism 70A are the same as those of the first embodiment.

As described above, according to the present embodiment, since a detection point is not changed in the detection mechanism 70A of the present embodiment as compared with the detection mechanism 70 according to the first embodiment, it is possible to suppress a difference in easiness of detecting the vibration of the transport belt 23 depending on the detection position.

The detection mechanism 70A may include a pressure contact force adjustment mechanism capable of adjusting the pressure contact force of the disk section 121 with respect to the transport belt 23. The pressure contact force adjustment mechanism includes, for example, a drive source such as a motor, and a conversion section for converting the drive force from the drive source into pressure contact force. The conversion section includes, for example, a power transmission mechanism that transmits power such as a ball screw or a gear. At this time, the pressure contact force adjustment mechanism may be controlled by the control section 1. That is, the control section 1 may control the pressure contact force of the disk section 121 with respect to the transport belt 23. While the detection mechanism 70A detects the vibration state of the transport belt 23, the control section 1 may control the pressure contact force adjustment mechanism to increase the pressure contact force of the disk section 121 against the transport belt 23.

Contents derived from the embodiments will be described below.

A transport device includes a transport belt configured to alternately repeat a transport operation of transporting a medium and a non-transport operation of not transporting the medium, a detection mechanism configured to detect a movement amount of the transport belt in the transport operation, and a control section configured to determine a magnitude of tension of the transport belt based on a vibration state of the transport belt when the transport operation ends, the vibration state being detected by the detection mechanism.

According to this configuration, the detection mechanism for detecting the movement amount of the transport belt can also be used as a unit for measuring the magnitude of the tension of the transport belt. Accordingly, it is not necessary to separately provide a sensor or the like for measuring the magnitude of the tension, and it is possible to suppress the structure of the transport device from being complicated.

In the transport device, it is desirable that the detection mechanism includes a scale section provided along a transport direction in which the medium is transported, a reading section configured to read marks formed on the scale section, and a gripping unit configured to move integrally with the scale section or the reading section, and configured to change state between a gripping state in which the gripping unit grips the transport belt and moves together with the transport belt and a non-gripping state in which the gripping unit does not grip the transport belt and the vibration state of the transport belt at the end of the transport operation is detected by the reading section reading vibration of the gripping unit in the gripping state.

According to this configuration, it is possible to apply to the transport belt, a force sufficient to vibrate the transport belt using inertia due to the mass of the gripping unit in the gripping state. This makes it easy to detect the vibration of the transport belt.

In the transport device, it is desirable that the gripping unit has at least one cling section configured to clingingly attract the transport belt, the gripping unit includes a first contact section configured to contact a front surface of the transport belt and a second contact section configured to contact a back surface of the transport belt, and the at least one cling section is provided on at least one of the first contact section and the second contact section.

According to this configuration, when the gripping unit vibrates, it is possible to suppress a situation in which the first contact section and the second contact section of the gripping unit slip with respect to the transport belt due to the inertia of the gripping unit and the tension cannot be accurately measured due to the vibration of the gripping unit.

It is desirable that the transport device includes a roller around which the transport belt is wound, wherein the detection mechanism includes a rotary encoder provided in a state in which a position with respect to the roller is fixed, the rotary encoder includes a disk section configured to contact the front surface of the transport belt and is configured to follow rotation with respect to the transport belt, and a reading section configured to read marks formed on the disk section, and the vibration state of the transport belt at the end of the transport operation is detected by the reading section reading the marks formed on the disk section.

According to this configuration, since the detection point in the detection mechanism does not change, it is possible to suppress a difference in ease of detection of the vibration of the transport belt depending on the detection position.

In the transport device described above, it is desirable that when a path along which the transport belt moves is defined as a movement path, the movement path includes a transport path in which the medium is supported and the medium is transported, and a non-transport path not constituting the transport path, the gripping state is a state in which the transport belt moving in the transport path of the movement path is gripped, and the control section determines the magnitude of tension of the transport belt based on the vibration state of the transport belt moving in the transport path.

According to this configuration, it is possible to measure the tension of the transport path that influences the transport accuracy of the medium more than the non-transport path.

A transport device includes a transport belt configured to alternately repeat a transport operation of transporting a medium and a non-transport operation of not transporting the medium, a detection mechanism configured to detect a movement amount of the transport belt in the transport operation, a drive roller that is provided downstream of the detection mechanism in a transport direction in which the medium is transported, and that rotationally moves the transport belt, and a control section configured to determine a magnitude of tension of the transport belt based on a difference between a target speed of the transport belt and a detected speed of the transport belt detected by the detection mechanism.

According to this configuration, the detection mechanism for detecting the movement amount of the transport belt can also be used as a unit for measuring the magnitude of the tension of the transport belt. Accordingly, it is not necessary to separately provide a sensor or the like for measuring the magnitude of the tension, and it is possible to suppress the structure of the transport device from being complicated.

A recording apparatus includes a recording section configured to record on a medium, a transport belt configured to alternately repeat a transport operation of transporting the medium and a non-transport operation of not transporting the medium, a detection mechanism configured to detect a movement amount of the transport belt in the transport operation, and a control section configured to determine a magnitude of tension of the transport belt based on a vibration state of the transport belt when the transport operation ends, the vibration state being detected by the detection mechanism.

According to this configuration, the detection mechanism for detecting the movement amount of the transport belt can also be used as a unit for measuring the magnitude of the tension of the transport belt. Accordingly, it is not necessary to separately provide a sensor or the like for measuring the magnitude of the tension, and it is possible to suppress complicating the structure of the recording apparatus.

A recording apparatus includes a recording section configured to record on a medium, a transport belt configured to alternately repeat a transport operation of transporting the medium and a non-transport operation of not transporting the medium, a detection mechanism configured to detect a movement amount of the transport belt in the transport operation, a drive roller that is provided downstream of the detection mechanism in a transport direction, in which the medium is transported, and that rotationally moves the transport belt, and a control section configured to determine a magnitude of tension of the transport belt based on a difference between a target speed of the transport belt and a detected speed of the transport belt detected by the detection mechanism.

According to this configuration, the detection mechanism for detecting the movement amount of the transport belt can also be used as a unit for measuring the magnitude of the tension of the transport belt. Accordingly, it is not necessary to separately provide a sensor or the like for measuring the magnitude of the tension, and it is possible to suppress complicating the structure of the recording apparatus.

What is claimed is:

1. A transport device comprising:

a transport belt configured to alternately repeat a transport operation of transporting a medium along a transport direction and a non-transport operation of not transporting the medium;

a detection mechanism configured to detect a movement amount of the transport belt in the transport operation and to detect a residual vibration of the transport belt by detecting a speed of the transport belt in a plus side and a minus side along the transport direction after applying to the transport belt a force or acceleration to vibrate the transport belt; and a control section configured to determine a magnitude of tension of the transport belt based on the residual vibration of the transport belt when the transport operation ends.

2. The transport device according to claim 1, wherein:

the detection mechanism includes a scale section provided along a transport direction in which the medium is transported, a reading section configured to read marks formed on the scale section, and a gripping unit configured to move integrally with the scale section or the reading section, and configured to change state between a gripping state in which the gripping unit grips the transport belt and moves together with the transport belt and a non-gripping state in which the gripping unit does not grip the transport belt, and the vibration state of the transport belt at the end of the transport operation is detected by the reading section reading vibration of the gripping unit in the gripping state.

3. The transport device according to claim 2, wherein the gripping unit has at least one cling section configured to clingingly attract the transport belt, the gripping unit includes a first contact section configured to contact a front surface of the transport belt and a second contact section configured to contact a back surface of the transport belt, and the at least one cling section is provided on at least one of the first contact section and the second contact section.

4. The transport device according to claim 1, further comprising:

a roller around which the transport belt is wound, wherein the detection mechanism includes a rotary encoder provided in a state in which a position with respect to the roller is fixed, the rotary encoder includes a disk section configured to contact the front surface of the transport belt and is configured to follow rotation with respect to the transport belt, and a reading section configured to read marks formed on the disk section, and the vibration state of the transport belt at the end of the transport operation is detected by the reading section reading the marks formed on the disk section.

5. The transport device according to claim 3, wherein when a path along which the transport belt moves is defined as a movement path, the movement path includes a transport path in which the medium is supported and the medium is transported, and a non-transport path not constituting the transport path, the gripping state is a state in which the transport belt moving in the transport path of the movement path is gripped, and the control section determines the magnitude of tension of the transport belt based on the vibration state of the transport belt moving in the transport path.

6. A transport device comprising:

a transport belt configured to alternately repeat a transport operation of transporting a medium along a transport direction and a non-transport operation of not transporting the medium;

a detection mechanism configured to detect a movement amount of the transport belt in the transport operation and to detect a residual vibration of the transport belt by detecting a speed of the transport belt in a plus side and a minus side along the transport direction after applying to the transport belt a force or acceleration to vibrate the transport belt;

a drive roller that is provided downstream of the detection mechanism in a transport direction in which the medium is transported, and that rotationally moves the transport belt; and a control section configured to determine a magnitude of tension of the transport belt based on the residual vibration between a plus side speed of the transport belt and a minus side speed of the transport belt detected by the detection mechanism.

7. A recording apparatus comprising:

a recording section configured to record on a medium;

a transport belt configured to alternately repeat a transport operation of transporting the medium along a transport direction and a non-transport operation of not transporting the medium;

a detection mechanism configured to detect a movement amount of the transport belt in the transport operation and to detect a residual vibration of the transport belt by detecting a speed of the transport belt in a plus side and a minus side along the transport direction after applying to the transport belt a force or acceleration to vibrate the transport belt; and a control section configured to determine a magnitude of tension of the transport belt based on the residual vibration of the transport belt when the transport operation ends.

* * * * *